US005979139A

United States Patent [19]

Early

[11] Patent Number: 5,979,139

[45] Date of Patent: Nov. 9, 1999

[54] LIGHTWEIGHT, SELF-SUPPORTING PANELING

[75] Inventor: Stephen R. Early, Olathe, Kans.

[73] Assignee: Aero Transportation Products, Inc., Independence, Mo.

[21] Appl. No.: 09/003,344

[22] Filed: Jan. 6, 1998

[51] Int. Cl.[6] ..... E04C 2/34

[52] U.S. Cl. ..... 52/791.1; 52/180; 52/662; 52/673; 52/675; 52/801.1; 29/897.32; 428/133; 428/134

[58] Field of Search ..... 52/789.1, 791.1, 52/798.1, 799.1, 801.1, 662, 661, 660, 673, 675, 663, 180; 29/897.15, 897.32; 428/132, 133, 134, 594, 597; 105/422

[56] References Cited

U.S. PATENT DOCUMENTS

| | | | |
|---|---|---|---|
| 802,727 | 10/1905 | Alschuler | 52/675 |
| 1,113,868 | 10/1914 | Berson | 29/897.15 X |
| 1,377,566 | 5/1921 | Eckart | 428/134 X |
| 1,433,232 | 10/1922 | Rogers | 52/443 |
| 1,576,559 | 3/1926 | Swift | 52/791.1 |
| 3,008,551 | 11/1961 | Cole | 52/791.1 X |
| 3,236,018 | 2/1966 | Graham et al. | 52/791.1 |
| 3,376,684 | 4/1968 | Cole et al. | 52/791.1 X |
| 3,673,057 | 6/1972 | Fairbanks | 428/116 |
| 3,793,791 | 2/1974 | Wootten | 52/789.1 |
| 3,925,946 | 12/1975 | Balinski et al. | 52/180 |
| 4,039,708 | 8/1977 | Okada | 428/73 |
| 4,426,824 | 1/1984 | Swensen | 52/791.1 |
| 4,522,860 | 6/1985 | Scott et al. | 52/673 X |
| 4,599,771 | 7/1986 | Trenkler et al. | 29/897.32 |
| 5,124,191 | 6/1992 | Seksaria | 52/789.1 X |
| 5,447,107 | 9/1995 | Iwaoka et al. | 52/798.1 X |

FOREIGN PATENT DOCUMENTS

| | | | |
|---|---|---|---|
| 498195 | 10/1950 | Belgium | 52/675 |
| 832231 | 9/1938 | France | 52/791.1 |
| 1045315 | 11/1983 | France | 52/791.1 |
| 616445 | 2/1961 | Italy | 52/673 |
| 850273 | 10/1960 | United Kingdom | 52/791.1 |
| 1054411 | 1/1967 | United Kingdom . | |
| WO 90/10769 | 9/1990 | WIPO | 52/799.1 |

*Primary Examiner*—Laura A. Callo
*Attorney, Agent, or Firm*—Chase & Yakimo, L.C.

[57] ABSTRACT

A paneling system includes a first upper or outer plate having a plurality of outwardly extending tabs unitarily and integrally formed therewith and a second, lower plate spaced apart from the upper plate to present a void therebetween. The tabs span the void and join with the second plate to fixedly secure the plates together to form the panel construction. The free ends of the tabs may be welded within slots formed in the second plate to secure the plates together. Alternatively, the tabs may be L-shaped to present a flange in parallel relation to the plates. The flanges are welded to the second plate to secure the plates together. The tabs may present anchor holes in the first plate for securing a load in place. The first plate may include a raised portion at the periphery of the anchor holes to help prevent skidding. A third plate may be included spaced apart from the first plate to form a void therebetween with the first plate having tabs secured to the second and third plates to form the panel construction.

9 Claims, 5 Drawing Sheets

LIGHTWEIGHT, SELF-SUPPORTING PANELING

FIELD OF THE INVENTION

This invention relates to a multi-purpose paneling system that is lightweight and very stiff or self-supporting. More specifically, the paneling may be used in cargo carriers such as trucks, trailers, railroad cars, ships and barges. The paneling may be used where non-skid surfaces are desirable, such as for flooring and walkways. The paneling also may be used in place of conventional construction reinforcement, such as concrete forms and reinforcing bar.

BACKGROUND OF THE INVENTION

Various types of sandwich construction floorings for different types of cargo carriers are known. However, these may require a structural underframe to provide sufficient support, depending upon the load to be carried. Other floorings may have adequate stiffness or rigidity but are relatively heavy and difficult to assemble. Such floorings also may not provide anchor holes or other means for easy securement of the load thereto.

SUMMARY OF THE INVENTION

Accordingly, a primary object of the subject invention is to provide a paneling system for any type of cargo carrier including a first plate that presents an upper or outer surface and has outwardly extending tabs unitarily and integrally formed therewith which secure the first plate to a second plate forming a void therebetween.

Another object of the subject invention is to provide paneling having spaced first and second plates and a core comprising a plurality of supporting tabs, and which is formed of either metal or rigid plastic to present a stiff, rigid self-supporting structure.

Another object of the subject invention is to provide paneling usable as flooring that does not require a structural underframe.

Still another object of the subject invention is to provide paneling that has anchor holes for securing a load.

Still another object of the subject invention is to provide paneling that may additionally function as duct work.

Yet another object of the subject invention is to provide paneling that may replace conventional types of reinforcement used in construction.

Yet another object of the subject invention is to provide a paneling system that is strong, rigid, lightweight and easy to assemble.

These objects are attained by providing a paneling system, comprising a first plate having a plurality of outwardly extending tabs unitarily and integrally formed therewith and a second plate spaced apart from the first plate to present a void therebetween. The tabs span the void and engage the second plate to fixedly secure the plates together to form the panel. The free ends of the tabs may be welded within mating slots formed in the second plate to secure the plates together. Alternatively, the tabs may be L-shaped and include a flange in parallel relation to the plates that is welded to the second plate to secure the plates together. The tabs may present anchor holes in the first plate for securing a load in place. The first plate may include a raised portion around the periphery of the anchor holes to present a substantially skid-proof surface.

DETAILED DESCRIPTION

Figure 15:
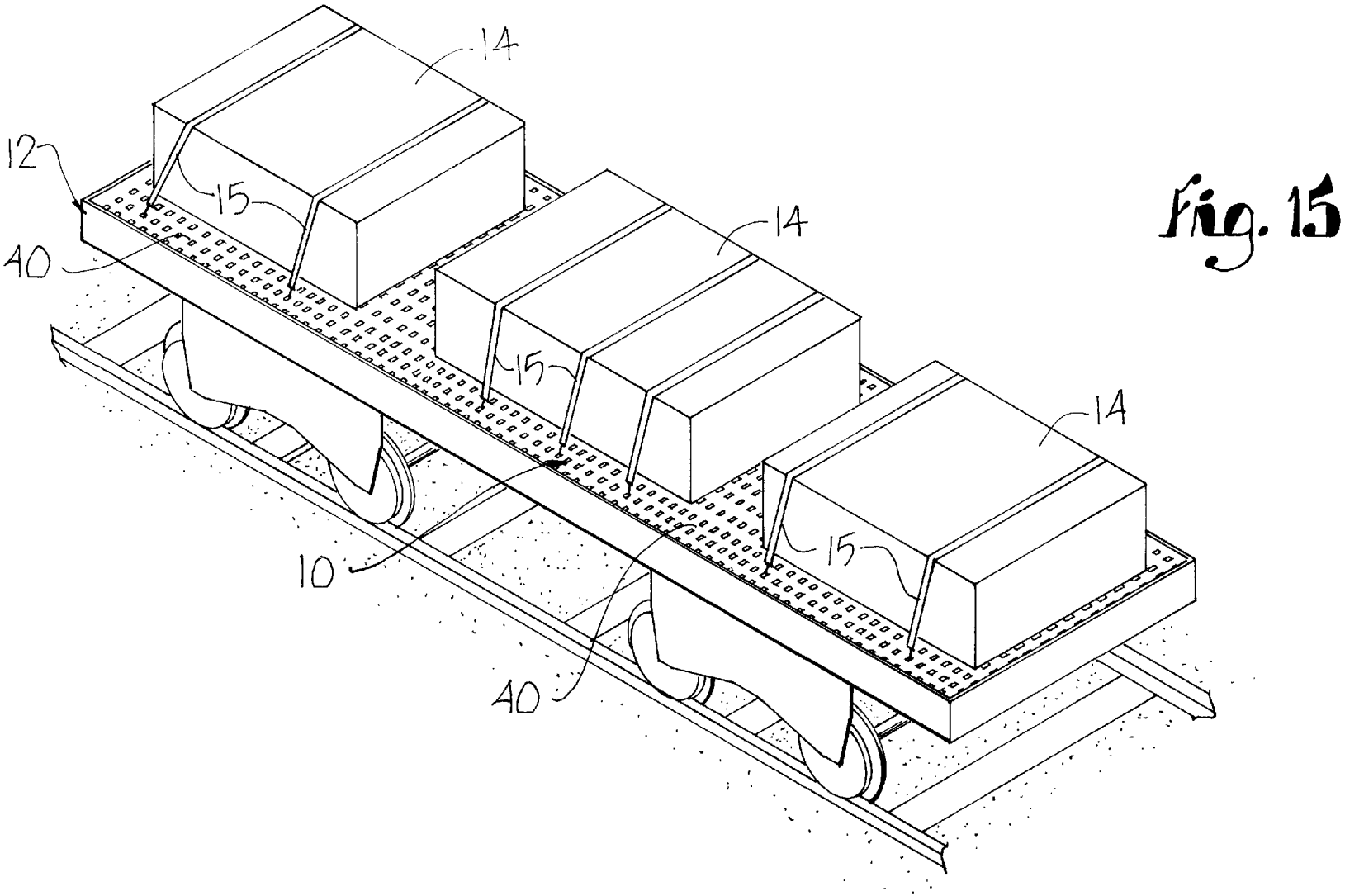
FIG. 15 is a perspective view of a floor panel in accordance with the present invention shown mounted and in use, carrying a load on a railroad car.

A panel 10, in accordance with the present invention, is shown in FIG. 15 as installed on a railroad car 12 for carrying a load 14. The panel 10 as shown is especially adapted for railroad car use, but may be employed with any type of cargo carrier, such as trucks and trailers, and in many other applications as discussed herein.

Although the panels shown in the drawings are referred to herein primarily as floor panels, they may also be used to form roofs, ceilings or side walls. Panel 10 generally has many applications as previously discussed.

As shown in detail in FIGS. 1–12, floor panel 10 includes a first, top or upper plate 20 spaced apart from and mounted on a second, bottom or lower plate 22 in parallel relationship. The plates 20 and 22 are identically sized and spaced apart with the upper plate 20 being directly aligned over the lower plate 22. Plates 20 and 22 are preferably formed of the same material, either sheet metal or a rigid plastic.

Figure 1:
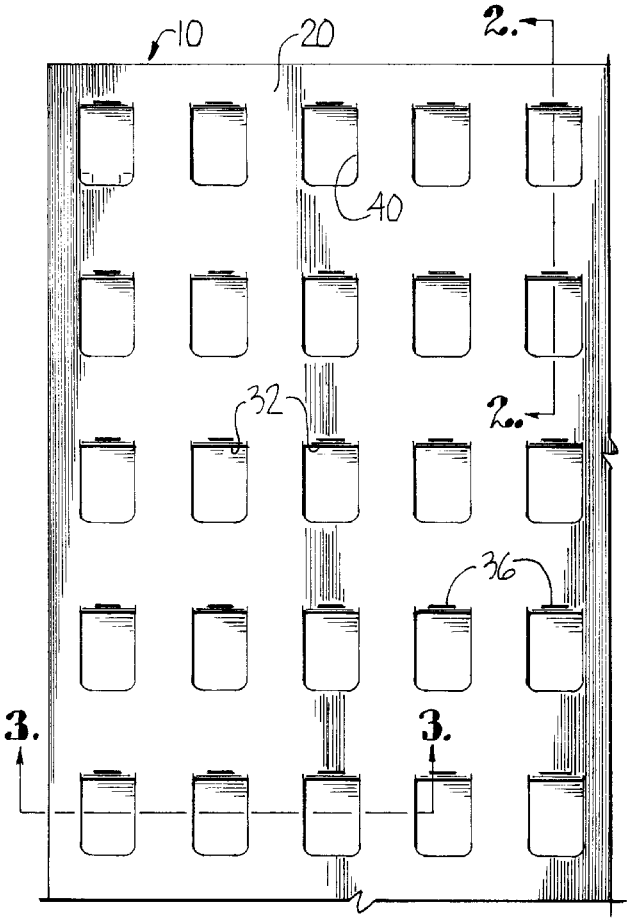
FIG. 1 is a partial top plan view of a floor panel in accordance with the present invention.
Figure 2:
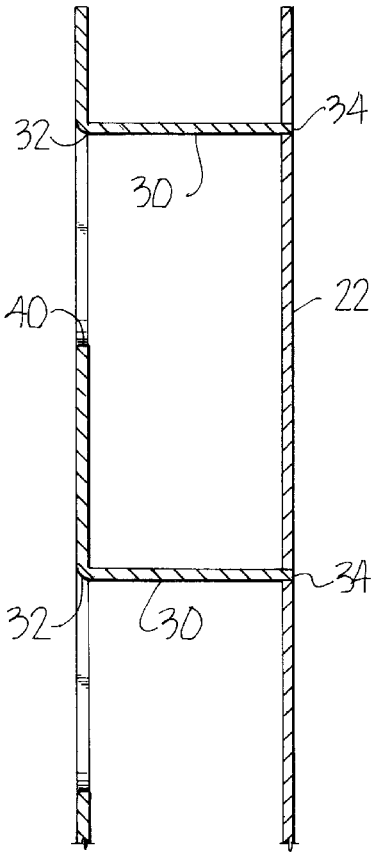
FIG. 2 is an enlarged cross-section of the panel of FIG. 1 taken along line 2—2.
Figure 3:
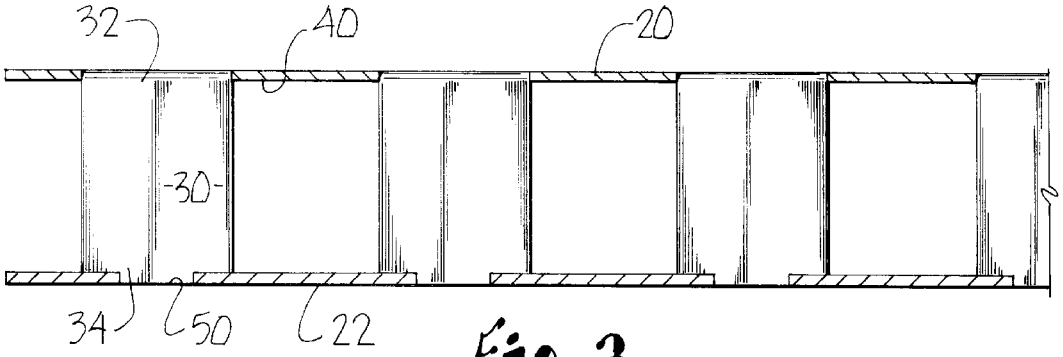
FIG. 3 is an enlarged cross-section of the panel of FIG. 1 taken along line 3—3.

More specifically, a first embodiment of floor panel 10 is shown in FIGS. 1–3. In this embodiment, plates 20 and 22 are substantially smooth and flat. Upper plate 20 has a plurality of downwardly extending tabs 30 unitarily and integrally formed therewith. The tabs 30 are cut in the plate 20 and bent downwardly at a right angle. The tabs 30 span the space or void between plates 20 and 22 and fit in mating slots 50 in the lower plate 22 to fixedly secure the plates 20 and 22 together to form the floor panel 10.

Each of the tabs 30 includes a first end 32 at upper plate 20, a second free end 34 and a bending slit 36. The second, free end 34 is spot welded to the lower plate 22 to secure the plates 20 and 22 together. Tabs 30 are arranged in a pattern to form rows and columns and present anchor holes 40 in the upper plate 20 for securing a load in place. In this regard, see FIG. 15 which shows the load 14 secured on floor panel 10 by ties 15 that extend through anchor holes 40.

As may be appreciated from FIGS. 2 and 3, the slots 50 in lower plate 22 are in alignment with corresponding downwardly bent tabs 30. The free ends 34 of tabs 30 are spot welded within slots 50.

To assemble floor panel 10 as in FIGS. 1–3, tabs 30 are stamped in upper plate 20 and slots 50 are stamped in lower plate 22. The tabs 30 are bent downwardly and outwardly from upper plate 20 until substantially perpendicular thereto. The bending slits 36 weaken the plate material and facilitate this process. The free end 34 of each tab 30 is mated within the corresponding slot 50 of lower plate 22. Free ends 34 are then spot welded within their corresponding slots 50 to thereby secure upper plate 20 to lower plate 22. Tabs 30 provide sufficient support and rigidity to floor panel 10 to support a substantial load, as illustrated by the load 14 on the railroad car 12 in FIG. 13. Thus, floor panel 10 is lightweight, rigid and self-supporting for use in many applications.

Figure 4:
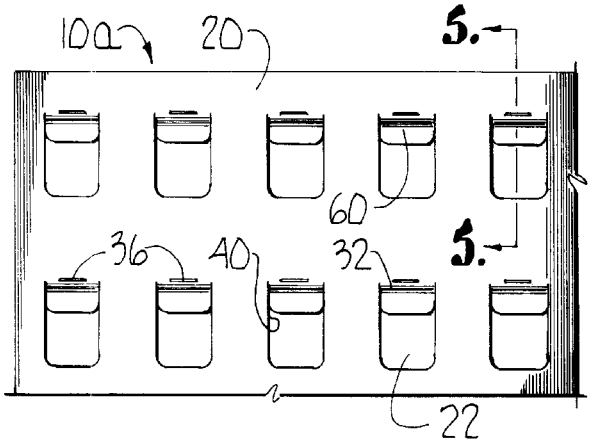
FIG. 4 is a partial top plan view of a second embodiment of a panel in accordance with the present invention.
Figure 5:
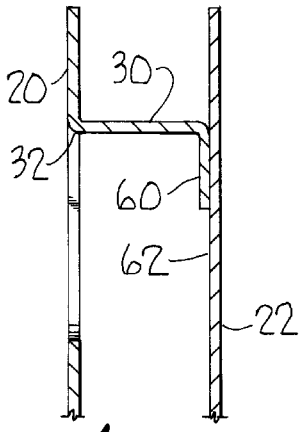
FIG. 5 is an enlarged cross-section of the panel of FIG. 4 taken along line 5—5.

Now turning to the second embodiment, as shown in FIGS. 4 and 5, floor panel 10*a* is substantially identical to floor panel 10 except that the free end of each tab 30 forms a flange 60, and lower plate 22 does not include slots. Flanges 60 extend parallel to plates 20 and 22. Thus, in assembly, the tabs 30 are bent downwardly and outwardly from the upper plate 20 and the flanges 60 are bent outwardly from the main tab portions at a substantially 90° angle thereto. These flanges 60 are then welded to the inner surface 62 of the lower plate 22.

As an alternative to either of the above-described techniques of welding tabs 30 to secure plates 20 and 22 in a spaced relationship, tabs 30 may be mechanically secured to plate 22. For example, a wedge key, clip, bolt or weld studs could be used.

Figure 6:
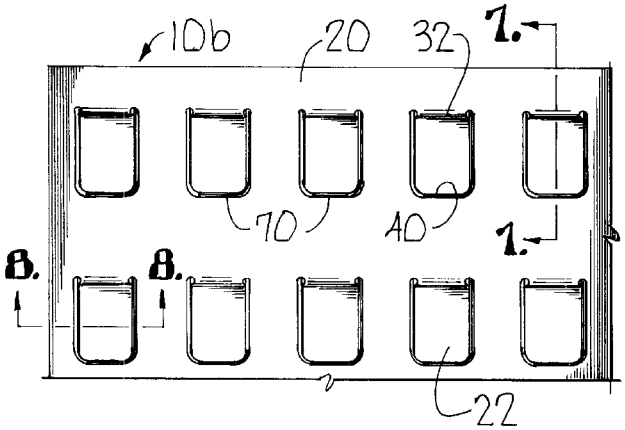
FIG. 6 is a partial top plan view of a third embodiment of a panel in accordance with the present invention.
Figure 7:
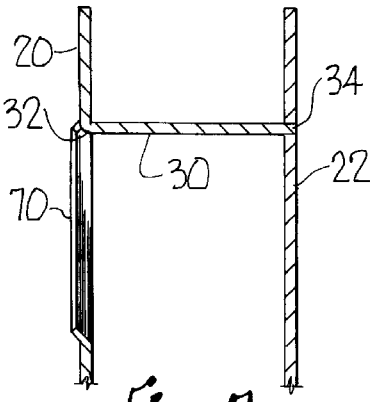
FIG. 7 is an enlarged cross-section of the panel of FIG. 6 taken along line 7—7.
Figure 8:
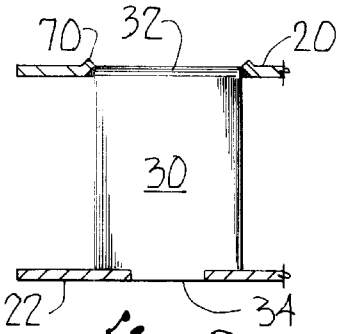
FIG. 8 is an enlarged cross-section of the panel of FIG. 6 taken along line 8—8.

FIGS. 6–8 depict a third embodiment, floor panel 10*b*. This embodiment is substantially identical to the first embodiment except that the upper plate 20 is not entirely flat but includes a raised portion 70 extending partially around the periphery of each anchor hole 40 to provide a substantially non-skid surface.

Figure 9:
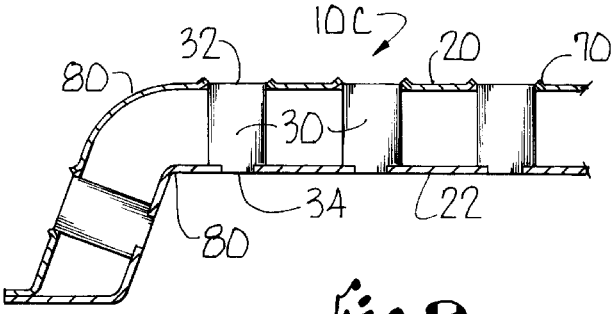
FIG. 9 is a cross-section of a modified form of the third embodiment showing a curved panel in accordance with the present invention.

FIG. 9 depicts a modified construction panel 10*c* that includes raised portions 70 as in the third embodiment. In addition, it includes downwardly curved outer portions 80 of the upper and lower plates 20 and 22. Thus, the floor panel 10*c* may be used in applications where an elevated floor is desired.

Figure 10:
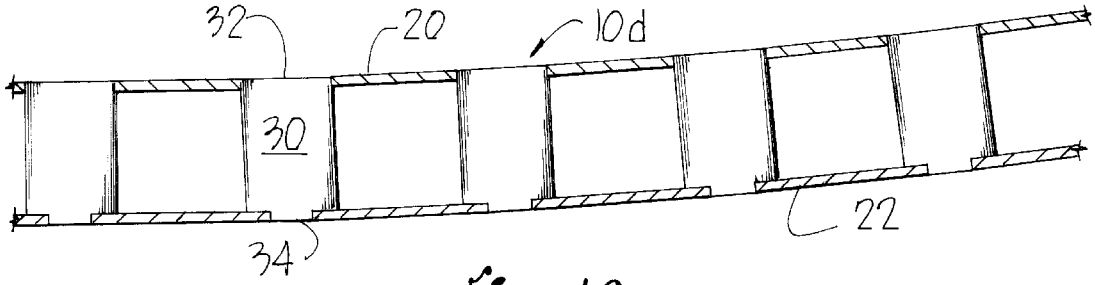
FIG. 10 is a cross-section of a curved panel employing the construction shown in FIGS. 1–3.

A curved panel 10*d* may also be provided by the present invention as illustrated in FIG. 10.

Figure 11:
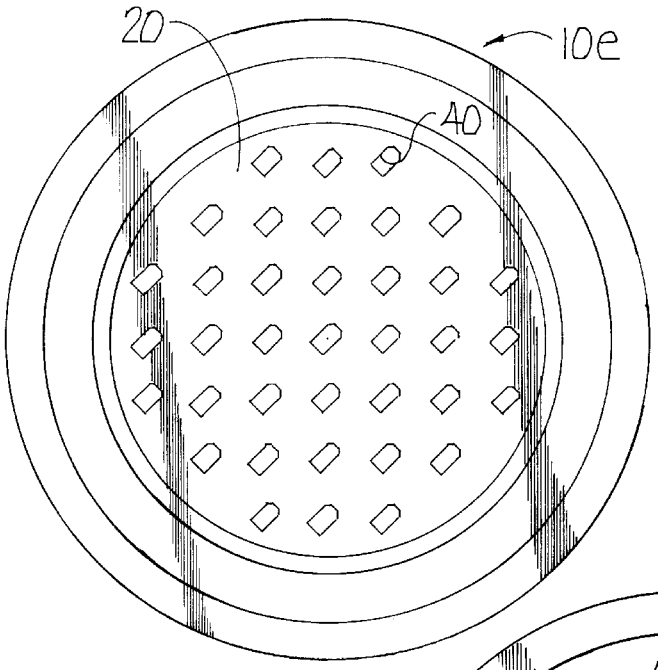
FIG. 11 is a top plan view of a circular floor assembly showing tabs arranged in a pattern to accommodate that configuration.
Figure 12:
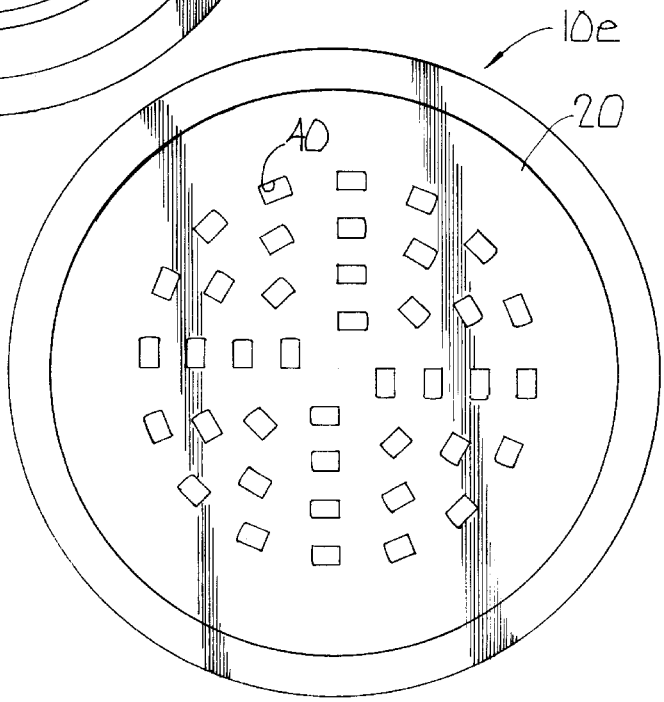
FIG. 12 is a top plan view of the floor panel of FIG. 10 but showing an alternative tab arrangement.

A circular floor assembly is shown in FIGS. 11 and 12. The construction is virtually identical to the first embodiment, except that the upper and lower plates 20 and 22 are round to present a circular floor panel 10*e*. FIGS. 11 and 12 show two different pattern configurations for tabs 30 in such a circular application.

Figure 13:
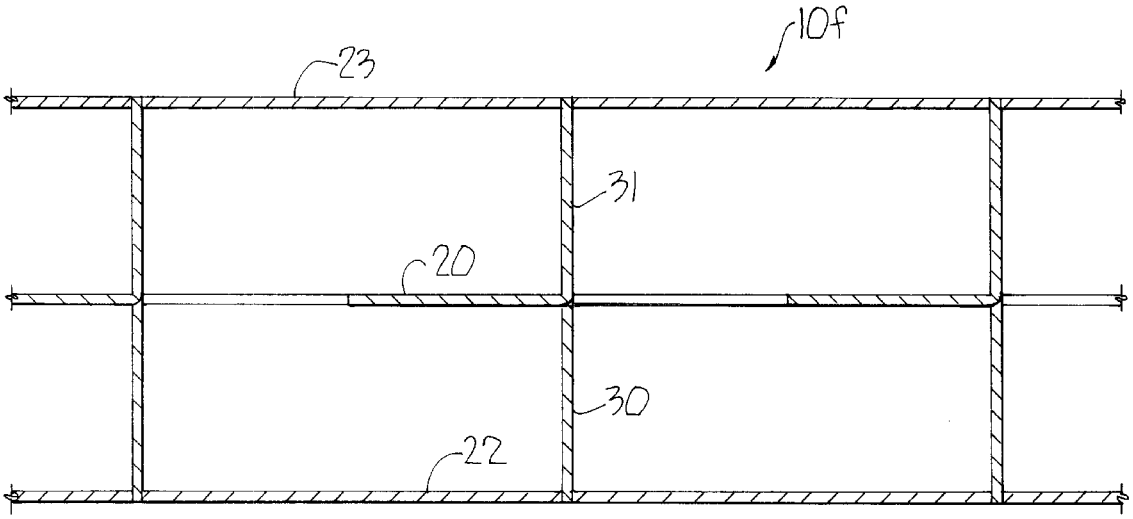
FIG. 13 is a side view of yet another embodiment of a panel having a third plate in accordance with the present invention.
Figure 14:
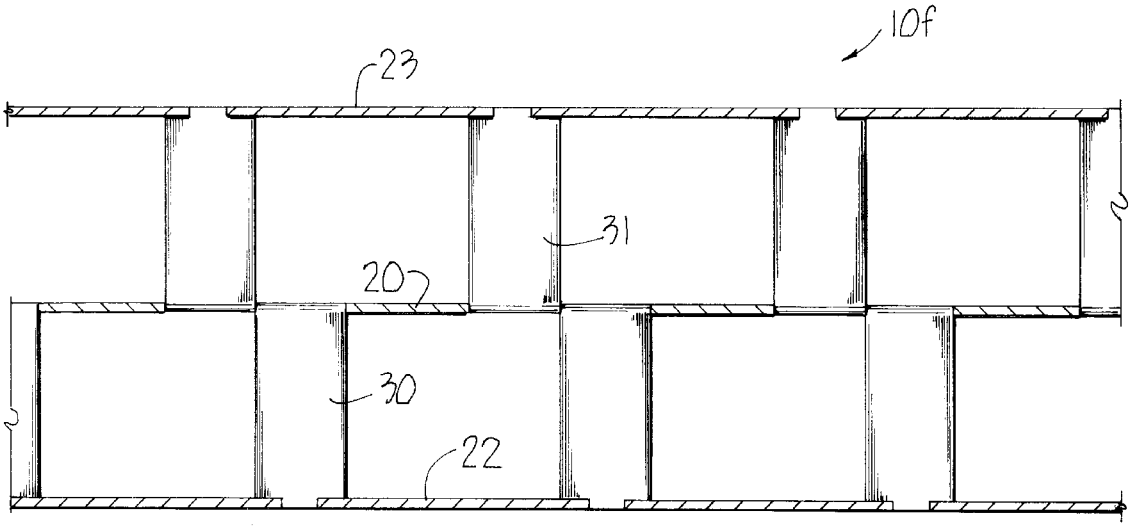
FIG. 14 is a cross-section of the panel of FIG. 13.

A final embodiment, panel 10*f*, is shown in FIGS. 13 and 14. This embodiment includes a third plate 23 spaced apart from the first plate 20 opposite the second plate 22 to present a second void therebetween. Tabs 30 and 31 are stamped in first plate 20 and alternately extend downwardly and upwardly therefrom with the free ends of tabs 30 and 31 secured to plates 22 and 23. Tabs 30 and 31 are not stamped in either outer plate 22 and 23 and thus do not form anchor holes therein. Instead, panel 10*f* may additionally be used as duct work.

This embodiment enables a lower cost panel to be provided that is formed of high cost material, such as stainless steel. For instance, the outer second and third plates 22 and 23 could be stainless steel with the middle, first plate 20 having tabs 30 and 31 extending therefrom being formed of less expensive steel.

It is to be understood that while certain forms of this invention have been illustrated and described, it is not limited thereto except insofar as such limitations are included in the following claims thereof.

Having thus described the invention, what is claimed as new and desired to be secured by Letters Patent is as follows:

1. A panel system, comprising:

a first plate having a plurality of substantially rectangular apertures therein with one outwardly extending corresponding rectangular tab extending from a side of each corresponding said aperture and each said tab having substantially the same area as its said corresponding aperture, a second plate spaced apart from said first plate to present a first void therebetween, said tabs spanning said void and engaging said second plate to fixedly secure said plates together to present a self-supporting panel construction, a long side of each said aperture being adjacent another said aperture's long side and each aperture's corresponding tab extending from a short side of said corresponding aperture, said second plate presenting a flat outer panel surface, a free end of each of said tabs being joined to said second plate to secure said plates together.

2. A panel system as claimed in claim 1 wherein said second plate has slots therein with which free ends of respective said tabs mate to secure said plates together, said free ends and said second plate presenting a substantially flat outer panel surface.

3. A panel system as claimed in claim 1 wherein each of said tabs is generally L-shaped and said free ends present a flange joined to said second plate to secure said plates together.

4. A panel system claimed in claim 1 wherein said tabs are arranged in a predetermined pattern.

5. A panel system claimed in claim 1 wherein said tabs are arranged to present rows and columns thereof.

6. A panel system claimed in claim 1 wherein said apertures present anchor holes in said first plate-for securing a load in place.

7. A panel system claimed in claim 6, wherein said first plate includes a raised portion at a periphery of each of said anchor holes.

8. A panel system as claimed in claim 6 wherein said plates include an arcuate outer portion for providing an elevated floor.

9. A panel system as claimed in claim 1, further comprising:

a third plate spaced apart from said first plate opposite said second plate to form a second void between said first and third plates, said tabs including a first set and a second set, said first set spanning said first void and engaging said second plate and said second set, spanning said second void and engaging said third plate, to fixedly secure said plates together, said second and third plates presenting flat outer panel surfaces.

* * * * *

UNITED STATES PATENT AND TRADEMARK OFFICE

CERTIFICATE OF CORRECTION

PATENT NO. : 5,979,139

DATED : November 9, 1999

INVENTOR(S) : STEPHEN R. EARLY

It is certified that error appears in the above-identified patent and that said Letters Patent is hereby corrected as shown below:

Column 4, line 50, delete "6" and insert --1--.

Signed and Sealed this

Second Day of May, 2000

*Attest:*

*Attesting Officer*

Q. TODD DICKINSON

*Director of Patents and Trademarks*